US006079167A

United States Patent [19]

Voegele, Jr.

[11] Patent Number: 6,079,167

[45] Date of Patent: Jun. 27, 2000

[54] CONTINUOUS RIDGE SKYLIGHT SYSTEM

[76] Inventor: William P. Voegele, Jr., 1096 Fox Chapel Rd., Pittsburgh, Pa. 15238

[21] Appl. No.: 09/414,661

[22] Filed: Oct. 4, 1999

[51] Int. Cl.[7] ..... E04D 13/03

[52] U.S. Cl. ..... 52/200; 52/199; 52/41; 52/42; 52/43; 52/44

[58] Field of Search ..... 52/199, 200, 41, 52/42, 43, 44

[56] References Cited

U.S. PATENT DOCUMENTS

| | | | |
|---|---|---|---|
| 1,379,359 | 5/1921 | Partzschefeld | 52/200 |
| 1,401,208 | 12/1921 | Sylvan | 52/199 |
| 1,772,068 | 8/1930 | Cibulas . | |
| 1,872,868 | 8/1932 | Abronski . | |
| 3,455,073 | 7/1969 | Kiekhaefer | 52/200 |
| 3,473,276 | 10/1969 | Back | 52/52 |
| 4,274,234 | 6/1981 | Abell | 52/63 |
| 4,614,067 | 9/1986 | Matsubara . | |
| 4,712,338 | 12/1987 | Trickel | 52/90 |
| 4,860,511 | 8/1989 | Weisner | 52/200 |
| 5,212,913 | 5/1993 | Whitehead . | |
| 5,553,425 | 9/1996 | Sampson | 52/200 |
| 5,640,812 | 6/1997 | Crowley | 52/90.1 |

FOREIGN PATENT DOCUMENTS

| | | |
|---|---|---|
| 292551 | of 0000 | Germany . |
| 642096 | of 0000 | Japan . |
| 1534161 | of 0000 | Russian Federation . |
| 1724830 | of 0000 | Russian Federation . |

*Primary Examiner*—Christopher T. Kent
*Assistant Examiner*—Kevin McDermott
*Attorney, Agent, or Firm*—J. Stewart Brams

[57] ABSTRACT

A building skylight system providing novel and improved cooperation between the skylight and a standing seam roof structure to accommodate thermally induced movement of the standing seam roof panels.

15 Claims, 4 Drawing Sheets

FIG. 6
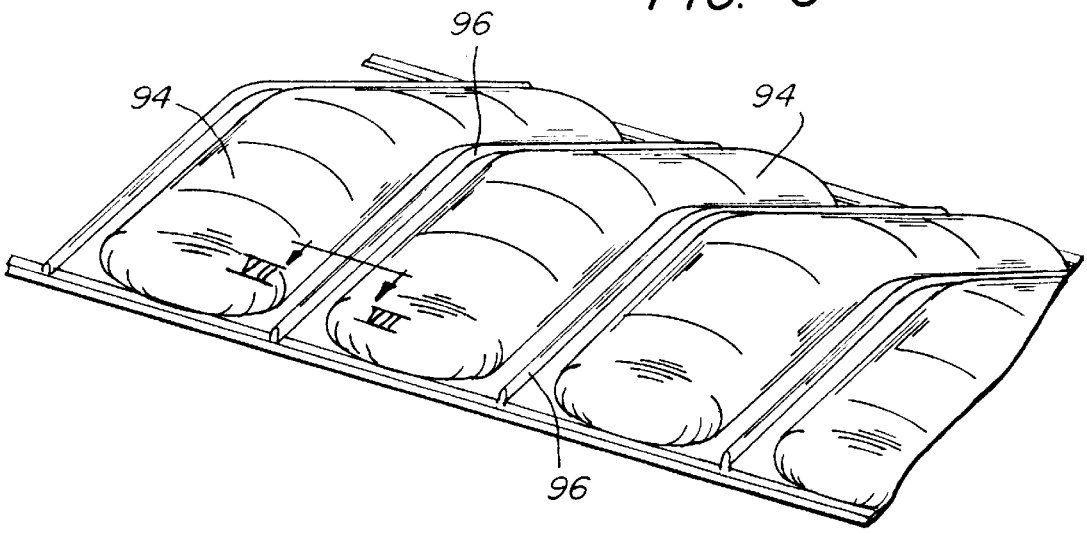
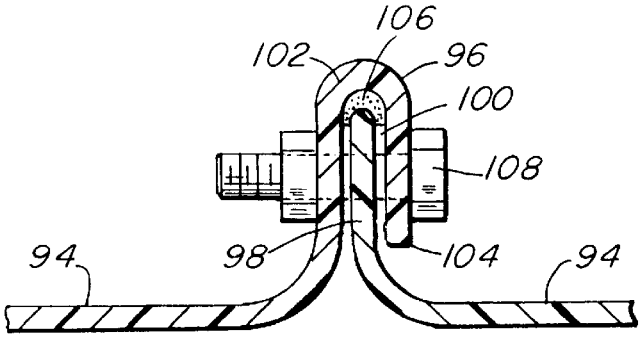
FIG. 7

CONTINUOUS RIDGE SKYLIGHT SYSTEM

BACKGROUND OF THE INVENTION

Natural interior lighting is desirable in commercial buildings for a variety of reasons including, among others, energy use efficiency and enhancement of the workplace environment. A variety of skylight systems thus are known and used. For example, it has been common practice to install individual skylight panels on a pitched roof at points below the roof ridge. Another skylight arrangement includes a series of adjacent, light transmitting panels that bridge the ridge of a double pitched roof and extend along the ridge.

Any skylight system must, of course, be well adapted to installation in a building roof structure. A roof structure of increasingly common use is the so-called standing seam roof, in which elongated sheet metal roof panels, up to 150 feet in length for example, extend from the building eaves to the roof ridge, and are joined to the adjacent roof panels at formed, upstanding seams that likewise run from the eaves to the ridge.

In a standing seam roof installation, the roof panels typically are immovably secured to the roof frame at the eaves, and further secured with sliding clips positioned at intervals along the length of the standing seams. The sliding freedom of the clips leaves the roof panels free to move for accommodation of thermal expansion and contraction, which can be substantial owing to the length of the roof panels. Since the roof panels are fixed to the roof frame at the eaves, the largest roof panel movement occurs at the roof ridge, and this complicates ridge skylight installation. Among the problems associated with skylight systems generally, including ridge skylights, are leakage and condensation, curb or flashing fit, safety, and positive termination of the blanket insulation that commonly underlies the roof panels.

Among the skylight systems represented in the prior art are the following: Russian Patents SU 1534161 and SU 1724830, U.S. Pat. Nos. 4,614,067, 1,872,868, 1,772,068, German Patent 292551, and Japanese Patent 6-42096. U.S. Pat. No. 5,212,913 discloses a roof ridge fitting, although not a skylight.

BRIEF SUMMARY OF THE INVENTION

The present invention obviates the above and other skylight construction problems and allows for unrestricted thermal expansion and contraction of metal roofing by providing, in the skylight assembly, a flexible, dome shaped element that accommodates relative movement between the sheet metal roofing and the skylight structure. In one embodiment that is especially well suited for smaller skylight openings, the flexible element is the skylight glazing material itself, which acts in the manner of a bellows to accommodate the thermal movement of the sheet metal roofing. In another embodiment that is better suited for larger skylight openings and other designs in which flexible glazing material would be impractical, an elastomeric or similar waterproof membrane bridges the space between the skylight curb and the adjacent sheet metal roofing, and flexes to accommodate relative movement between the curb and the roofing.

For the first mentioned embodiment, the flexible glazing may be any suitable material, including but not limited to glass, fiberglass, or thermoplastics such as cellular or sheet acrylic or polycarbonate. For the latter embodiment, since flexibility is not required, the glazing may be of a semi-rigid thermoplastic material such as polycarbonate or acrylic that is formed into a functional or structural shape to provide strength to the span of glazing, e.g., a dome or a beam configuration, or to provide a perimeter configuration for strong, waterproof attachment to an adjacent skylight panel.

It is therefore one object of the invention to provide a novel and improved ridge skylight system for a building roof.

A more specific object of the invention is to provide a novel and improved skylight system for use with standing seam roof structures.

These and other objects and advantages of the invention will be more readily appreciated and understood upon consideration of the following detailed description and the accompanying drawings, in which:

FIG. 6 is a perspective view of a ridge skylight system showing structural features of the skylight glazing; and FIG. 7 is a sectional view taken on line VII—VII of FIG. 6.

DESCRIPTION OF THE PREFERRED EMBODIMENTS

For purposes of the following description, the directional indications inner or inward, and outer or outward, refer respectively to the directions toward and away from the roof ridge along the slope of the roof pitch.

Figure 1:
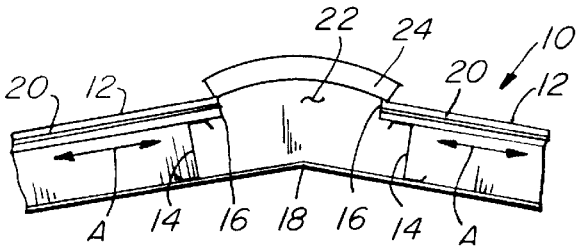
FIG. 1 is a fragmentary section of the ridge portion of a double pitched roof with a ridge skylight according to one embodiment of the present invention.

In FIG. 1 the ridge portion of a building roof 10 is shown. The roof structure includes known roof panels such as standing seam roof panels 12 of sheet metal which are supported on purlins 14. The panels 12 extend in elongated strips from the opposed eaves (not shown) up the slope of the roof pitch to terminal ends 16 adjacent to the ridge 18. Upstanding seams 20, also running along the slope of the roof from eaves to ridge, joint adjacent panels 12. A gap 22 between terminal ends 16 is bridged by a skylight 24 to provide natural lighting for the building interior. Skylight 24 is preferably a continuous ridge skylight system, meaning that it extends continuously along some substantial portion of the ridge.

The sheet metal roof panels 12 are immovably secured to the roof frame at the building eaves. Along the length of the roof slope or pitch, sliding clips 26 are fastened to purlins 14 and slideably engaged in seams 20 in a manner to permit the roof panels 12 to move with respect to purlins 14 in the direction of the roof slope as indicated by arrows A. This freedom allows accommodation of the thermal expansion and contraction of the roof panels 12 so that they will not bulge or buckle with changes in the ambient temperature. The coefficient of thermal expansion for sheet metal roofing, the range of temperatures to which the roof is exposed, and the length of the roofing panels (up to 150 feet or more) produce substantial thermal movement in the roofing panels, with the maximum movement occurring at terminal ends 16. Of course, the structure and installation of skylight 24 must accommodate the thermal expansion and contraction of the roof panels 12.

Figure 2:
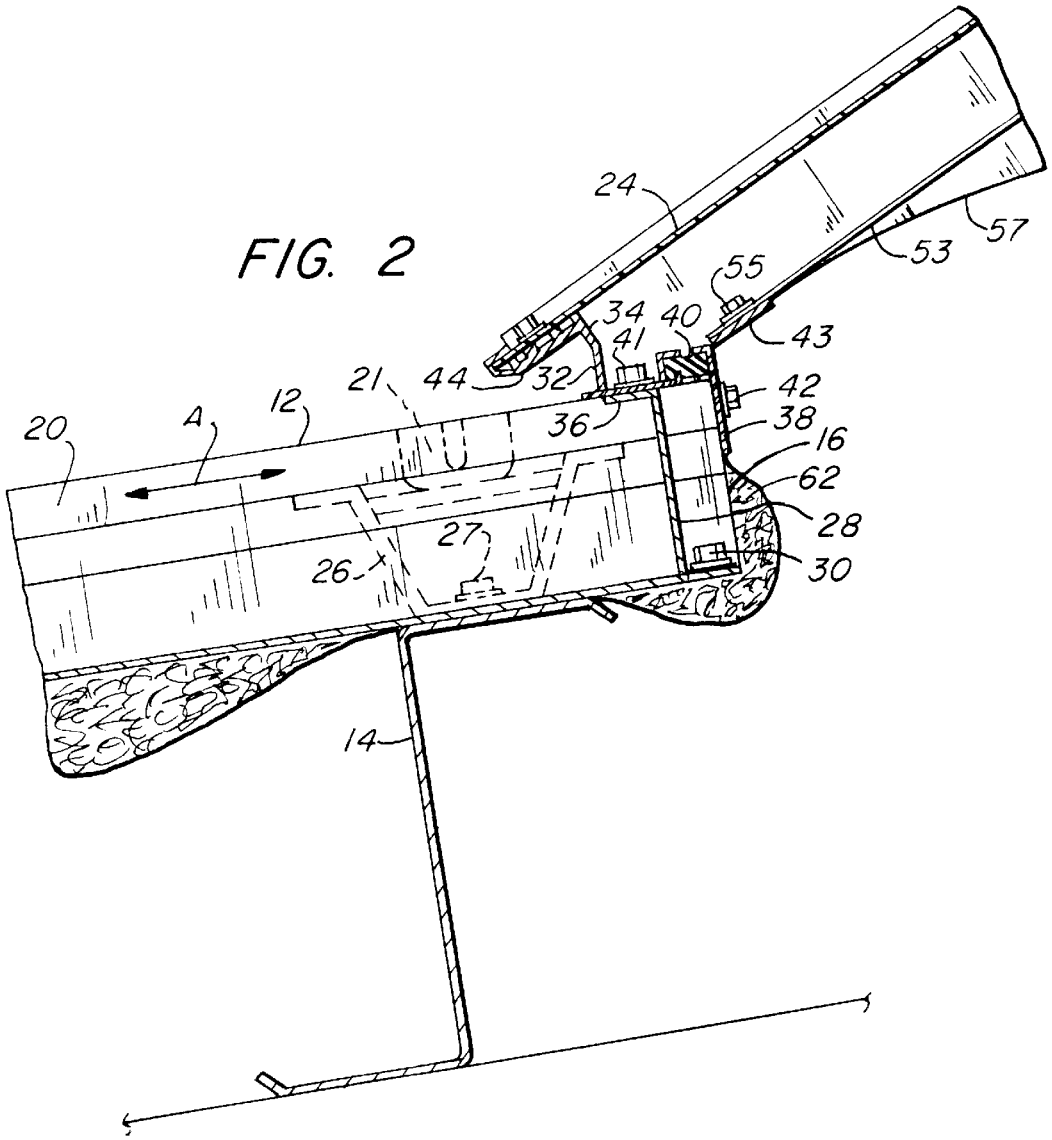
FIG. 2 is an enlarged portion of FIG. 1.

Referring to FIG. 2, a fragmentary part of FIG. 1 is shown, including a terminal end portion 16 of a roof panel 12 supported on a purlin 14 and having an upstanding seam portion 20 by which it is attached to an adjacent roof panel 12. Each roof panel 12 is secured to purlin 14 by a sliding clip 26 which allows each panel 12 to slide in the direction of arrow A with respect to purlin 14 for accommodation of thermal expansion and contraction. Typically, clips 26 may be secured to purlins 14 by suitable threaded fasteners 27, and suitably interlocked in seams 20 as indicated at 21.

The roof panel terminal ends 16 are finished by generally Z-shaped sheet metal closures 28 which extend in an upstanding orientation between the seams 20 at the opposed edges of the roof panel 12, and are fixed in place by suitable fasteners such as sheet metal screws 30.

The above described roof structure is well known in the art. Further detailed description thereof thus is believed unnecessary for an understanding of the invention described hereinbelow.

Figure 3:
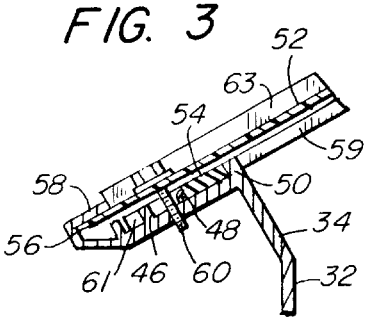
FIG. 3 is an enlarged portion of FIG. 2.

Referring further to FIGS. 2 and 3, an elongated aluminum sill extrusion 32 extends across a plurality of roof panel terminal ends 16 to support skylight 24 with respect to roof panels 12. Sill extrusion 32 is a unitary or composite element comprising: an upstanding, angled wall portion 34; a glazing support channel portion 44 atop wall 34; a first base portion 36 extending parallel to the roof slope at the bottom of wall 34; and a second base portion 38 extending downward from and perpendicular to base portion 36. A thermal break 40, of poured urethane, for example, is disposed between base portions 36 and 38 to reduce heat conduction through sill 32 between the interior and the exterior of the building and to thereby prevent condensation and drippage within the building.

The structural features of extrusion 32, as described, extend substantially continuously throughout its length. Sill 32 is secured in place by suitable threaded fasteners. Screws 41 placed at intervals along the length of extrusion 32 secure base portion 36 to the tops of roof panels 12 and to sheet metal closures 28, and additional screws 42 secure base portion 38 by engagement in the ends of roof panel seams 20.

The glazing support portion 44 of extrusion 32, shown in detail in FIG. 3, extends outward of angled wall 34, that is, away from roof ridge 18, so that the skylight glazing is supported outside the boundary defined by wall 34. More specifically, glazing support portion 44 includes a plurality of spaced apart, upstanding ridges 46, 48, 50 which extend longitudinally of the extrusion 32, and whose upper ends contact and support a glazing panel 52. A length of elastomeric foam tape 54 extends continuously under the glazing panel 52, within the space between ridges 48 and 50. The tape 54 serves as a weathersealing gasket between extrusion 32 and the glazing panel 52 supported thereby, and as such is provided in a thickness sufficient to ensure contact on its upper and lower sides with the glazing and the glazing support 44, respectively; however, tape 52 also is to be of a thickness that it is not compressed more than 50 percent between the glazing panel 52 and support 44 when glazing panel 52 is installed in engagement with ridges 46, 48 and 50.

Glazing 52 may be any suitable material which is capable of flexing or bending in response to thermal movement of the extrusion 32 as driven by the thermal movement of roof sheets 12. Suitable glazing materials 52 may include FRP or polycarbonate sheet, for example. When installed, the glazing 52 is disposed atop support portion 44 with its free edge 56 projecting under a lip or flange 58 extending along the outermost part of support portion 44, the flange 58 extending back toward roof ridge 18. Flange 58 secures glazing 52 against upward movement relative to extrusion 32. Screws 60 pass through glazing panel 52 and are engaged in support portion 44. Upon tightening of screws 60, glazing panel 52 is drawn down into engagement with ridges 46, 48, 50, and tape 54 is compressed to form a weather tight seal. The sealing and securing of the glazing panel 52 thus is laterally outside of the upstanding wall 34, which also serves as a boundary and barrier between the exterior and interior of the building. As one benefit of this arrangement, any leakage through or around the spaces between support portion 44 and glazing 52, or through the openings provided for screws 60, will fall outside of the barrier formed by upstanding wall 34.

It will be appreciated that the above describes the skylight structure on only one side of roof ridge 18. The structure on the opposed side of ridge 18 is identical to that described above. The glazing panel 52 is thus secured to a pair of sill extrusions 32 located, respectively, on opposite sides of roof ridge 18, and arches between them in an upwardly curved configuration so that the glazing can flex and bend in response to the thermal movement of the roof panel terminal ends 16, and the respective sill extrusions 32 carried thereby, toward and away from roof ridge 18. Other glazing arrangements are possible. For example, a pair of flat glazing panels oriented to slope away from the roof ridge in opposite directions, in the same manner as the roof panels, may be joined at a peak by a flexible, weather tight seal element to provide the required accommodation of roof panel thermal expansion and contraction.

Of course, glazing panels 52 must be of suitable and convenient lengths for such purposes as ease of installation and cost effective repairs. Nevertheless, as it is desired to provide a continuous ridge skylight system, in the described skylight structure a plurality of glazing panels 52 may be arranged in mutually adjacent relationship, each secured to the pair of spaced apart sill extrusions 32 as above described. At the junction between each pair of adjacent glazing panels 52, an elongated mullion 59 and a cover cap 63, both of aluminum for example, cooperate to provide the necessary seal between the adjacent glazing panels. The opposed ends 61 of mullion 59 overlap support portion 44 of the respective sill extrusions 32 and are interfitted therein in a space created by milling away a sufficient length of ridges 46, 48, 50 to provide space for receiving the mullion ends 61. A suitable cover cap 63 encloses the glazing-to-mullion junction as shown.

Additional features of the FIG. 1–3 embodiment include the following. A flange portion 43 of sill extrusion 32 projects inwardly or toward ridge 18 from the inner side of the thermal break 40 to provide support for an optional inner glazing 53 and optional safety screening 57, both of which may be secured to flange 43 by any suitable means, screw fasteners 55 for example. Regarding interior finishing, batt insulation, if desired, is secured by passing the end of the batt upwardly over the terminal ends 16 of the standing seam roof sheets, and capturing it under the depending base portion 38 of sill extrusion 32, as shown at 62 in FIG. 2.

The embodiment described above is suitable for smaller span skylights, for example up to approximately four feet, which have lesser structural support requirements than larger spans. The embodiment shown in FIG. 4 is suitable for such larger span skylights, although of course it would also be adequate for shorter spans as well.

Figure 4:
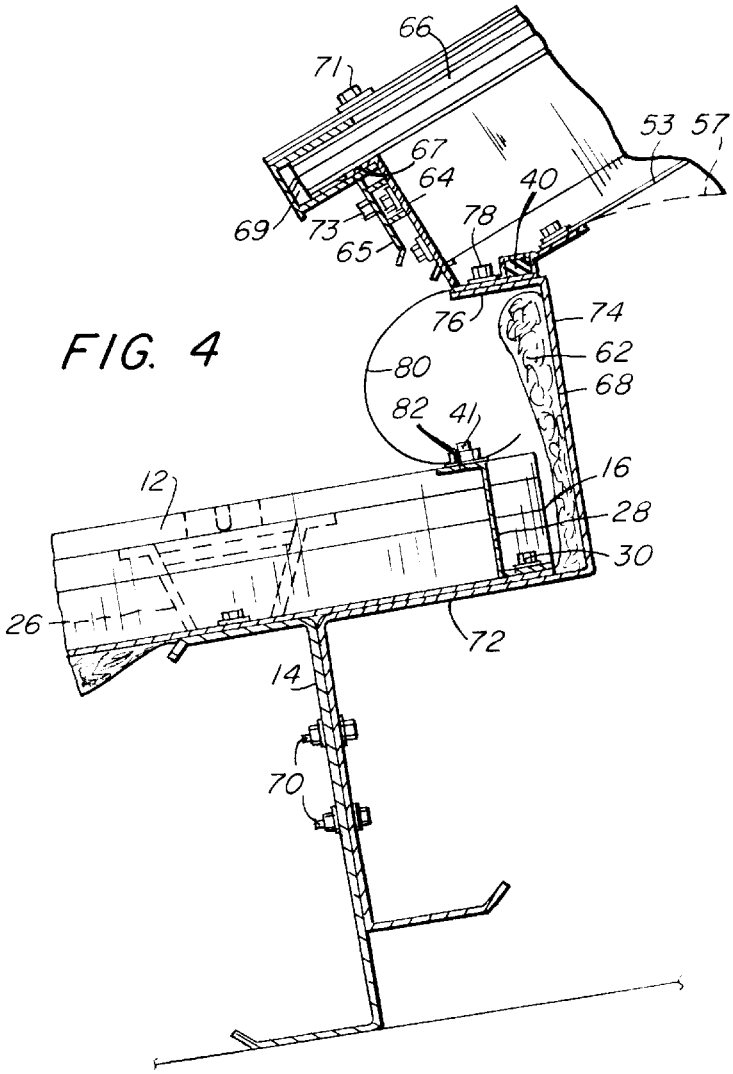
FIG. 4 is a view similar to FIG. 2 showing another embodiment of the invention.

In FIG. 4, a standing seam roof comprises roof panels 12 supported on a roof frame including purlins 14 by sliding clips 26 so that the panels 12 are free to move to accommodate thermal expansion and contraction. The terminal ends 16 of panels 12 are capped by Z-closures 28 secured thereto by screw fasteners 30. Furthermore, a sill extrusion 64 supports glazing 66 above and in overhanging relationship to the roof panel terminal ends 16, and, in addition, supports optional inner glazing 53 inwardly of a thermal barrier 40. All of the above described structure in FIG. 4 correspond essentially to the FIG. 1–3 description, excepting only that the specific configuration of sill extrusion 64 differs from that of sill extrusion 32 of FIGS. 1–3 in order to provide suitable cooperation with the skylight support structure described hereinbelow.

In FIG. 4, sill extrusion 64 is supported by the roof frame rather than by roof panel terminal ends 16. Specifically, an elongated, angular support member 68 is affixed to purlin 14 by screw or bolt fasteners 70. From there, member 68 extends under roof panel terminal ends 16 as indicated at 72, and then upwardly to an elevation above the terminal ends 16 as indicated at 74. Finally, an out-turned flange portion 76 of member 68 projects away from ridge 18 at the slope of the roof pitch. The member 68 does not necessarily extend continuously along the skylight structure, so long as its extent is sufficient for adequate support of the skylight. Sill 64 is carried atop flange portion 76 and secured thereto by suitable fasteners such as screw fasteners 78.

In the FIG. 4 embodiment, the skylight glazing is captured and retained by the extruded curb in a manner different from the FIG. 2–3 embodiment. In FIG. 4, curb or sill 64 includes an outwardly projecting flange portion 67. A cap extrusion 65 includes an elongated channel 69 which receives the outer edge portion of glazing 66 and engages beneath flange 67 to retain the glazing 66 with respect to sill extrusion 64. This structure allows the glazing 66 to be manually bent into its installed configuration and temporarily retained with respect to sill 64 while suitable fasteners such as indicated at 71 and 73 are installed to permanently retain glazing 66 and cap extrusion 65.

Since in the FIG. 4 embodiment, the sill 64 is supported by the roof frame rather than by the terminal ends 16 of the roof panels 12, the sill 16 does not move in concert with thermal expansion and contraction of the roof panels 12. Nevertheless, the overall structure must accommodate such movement as in all other embodiments. Hence, roof panels 12 are free to move with respect to the roof frame, by virtue of sliding clips 26, while the skylight structure is supported directly by the roof frame and remains relatively stationary.

To accommodate this differential movement, and to provide a weather seal between the movable and stationary structures, a flexible, weather tight bellows 80 extends between the base of sill 64 and the roof panel terminal ends 16. At its upper extent, bellows 80 is captured between flange 76 and the adjacent portion of sill 64, and secured by screw fasteners 78. At its lower extent, bellows 80 is captured beneath an aluminum bar 82, which is secured by screw fasteners 41. Bellows 80 preferably is an elastomeric membrane. A suitable material is, for example, EPDM (ethylene propylene diene monomer, a commonly known rubber roofing material) in sheets of about 0.60 in. thickness. For this embodiment, the batt insulation 62 is turned upward and extends along the outer side of support member portion 74, and is concealed by bellows 80.

Figure 5:
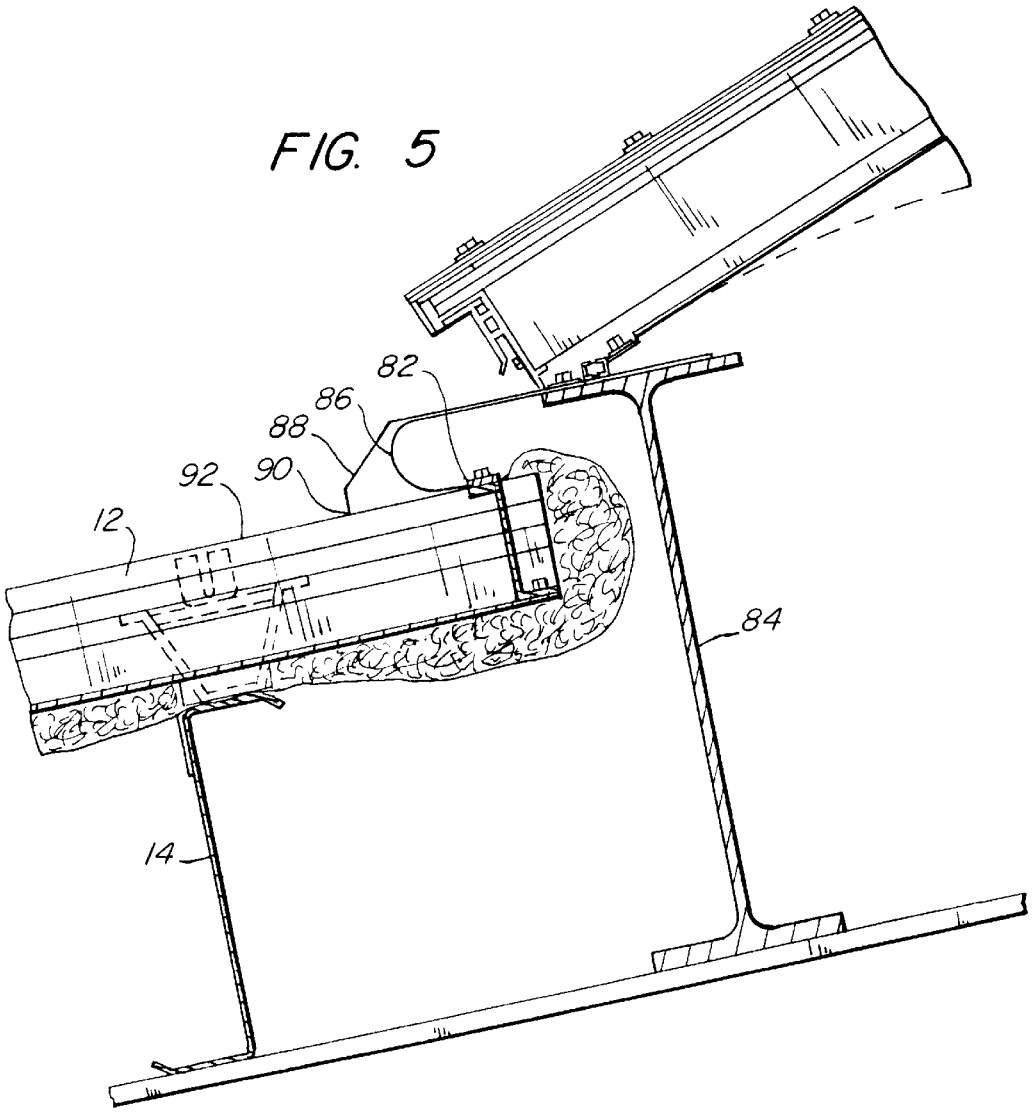
FIG. 5 is a view similar to FIG. 2 showing still another embodiment of the invention.

The FIG. 5 embodiment is similar in all salient respects to the FIG. 4 embodiment, however, as shown in FIG. 5 the structural member which supports the skylight can be any commonly known steel shape, such as an I-beam 84 for example. The beam 84 need not be attached directly to any of the purlins 14 which support roof panels 12. Rather, it is attached to the building trusses (not shown). A bellows seal 86 similar to that of FIG. 4 is provided. An additional feature, which may also be used with the FIG. 4 embodiment, comprises a finishing cap 88 that is captured in common with the upper end of bellows 86 and extends outward to a terminus 90 adjacent to the exposed upper surface 92 of roof panels 12. Cap 88 encloses and conceals the bellows 86.

FIGS. 6 and 7 illustrate a skylight with glazing panels that are suitable for various embodiments of the invention. In FIG. 6, skylight glazing panels 94 are of suitable heat formable material, acrylic or polycarbonate for example, which is formed into generally domed shapes with a geometry suitable to function as a structural beam spanning the space between the opposed support sills or curbs. The panels 94 are joined side by side along seams 96, details of one such seam being shown in FIG. 7. As shown, one of two adjacent glazing panels 94 includes an upturned flange 98 approximately 1½ in. high, for example the adjoining panel 94 includes a channel 100 formed between an upturned portion 102 which continues into a downturned portion 104. Channel 100 receives flange 98, and a continuous bead of elastomeric sealant 106 extends between the flange 98 and channel 100 to provide a weather tight seal. A plurality of screw or bolt fastener assemblies 108 retain the interengaged panels 94 along seams 96.

The height of seams 96 above the adjacent portions of panels 94 is sufficient to allow drainage of water without any possibility, under normally expected conditions, of leakage through the seams 96 into the building.

Although I have described my presently preferred, best mode embodiments of the invention, I have also contemplated various alternative and modified embodiments, and certainly such would also occur to others versed in the art once they were apprised of my invention. Accordingly, it is my intention that the invention should be construed broadly, in accordance with the scope of the claims appended hereto.

I claim:

1. In a pitched building roof with a skylight installed thereon, the combination comprising:

roof panel means extending along the plane of the building roof and having a terminal end portion located adjacent the uppermost elevation of the building roof;

said roof panel means being secured with respect to the building in a manner to accommodate relative movement of said terminal end toward and away from said uppermost elevation;

skylight means overlying said terminal end portion and extending at least to said uppermost elevation; and said skylight means including flexible means which flexes to accommodate relative movement of said terminal end portion toward and away from said uppermost elevation.

2. The combination as set forth in claim 1 wherein said roof panel means includes roof panels with respective terminal ends disposed adjacent respective opposite sides of the ridge of a double pitched roof, and said skylight means overlies said terminal ends and extends therebetween.

3. The combination as set forth in claim 1 wherein said skylight means includes a sill which forms at least a portion of a junction between said skylight means and said roof panel terminal end, and which additionally forms at least a portion of a weather barrier between the interior and the exterior of the building.

4. The combination as set forth in claim 3 wherein said flexible means includes an expanse of flexible glazing supported at least in part by said sill.

5. The combination as set forth in claim 4 wherein said flexible glazing is immovably fixed to said sill.

6. The combination as set forth in claim 5 wherein said sill includes an upstanding base portion and a glazing receiving portion which extends from said upstanding portion in a direction away from said uppermost elevation.

7. The combination as set forth in claim 6 wherein said glazing receiving portion includes a separable channel shaped member which is engageable with said sill and said expanse of flexible glazing to temporarily retain an edge portion of said glazing with respect to said sill prior to permanent installation of said glazing in said sill.

8. The combination as set forth in claim 3 wherein said roof panel means includes a plurality of elongated roof panels joined by upstanding seams extending along the pitch of the building roof to said roof panel terminal end, and said sill is supported by said roof panel terminal end.

9. The combination as set forth in claim 8 wherein said sill includes a base portion which engages said roof panel terminal end, said base portion having a first part which engages an upper surface of said terminal end and a second part depending from said first part and engaging an exposed end of said roof panel at said terminal end.

10. The combination as set forth in claim 9 additionally including fastener means securing said first and second parts to said roof panel terminal end, the fastener means securing said second part being engageable within said upstanding seams of said roof panel.

11. The combination as set forth in claim 3 wherein said flexible means includes a flexible bellows means extending between said roof panel terminal end portion and said sill.

12. The combination as set forth in claim 11 additionally including cap means enclosing said flexible bellows means.

13. The combination as set forth in claim 1 wherein said skylight means includes a pair of mutually parallel sills and a formed, self supporting glazing means which engages said sills and requires for support only its own structure and its engagement with said pair of sills.

14. The combination as set forth in claim 4 wherein said glazing means includes a plurality of glazing panels, each having integrally formed joint means for weathertight and structurally self supporting engagement with adjacent ones of said plural glazing panels.

15. The combination as set forth in claim 14 wherein said integrally formed joint means includes a male and a female joint portion disposed at the opposed sides, respectively, of each said glazing panel.

* * * * *